United States Patent [19]

Gertz et al.

[11] Patent Number: 5,022,782

[45] Date of Patent: Jun. 11, 1991

[54] VEHICLE CRASH BARRIER

[75] Inventors: David C. Gertz, Citrus Hts.; William G. Krage, Fair Oaks, both of Calif.

[73] Assignee: Energy Absorption Systems, Inc., Chicago, Ill.

[21] Appl. No.: 452,791

[22] Filed: Dec. 18, 1989

Related U.S. Application Data

[63] Continuation-in-part of Ser. No. 439,654, Nov. 20, 1989.

[51] Int. Cl.[5] ..... E01F 13/00; E01F 15/00

[52] U.S. Cl. ..... 404/6; 256/13.1

[58] Field of Search ..... 404/6; 256/1, 13.1, 256/19; 188/65.1, 67, 377; 248/66

[56] References Cited

U.S. PATENT DOCUMENTS

| | | | |
|---|---|---|---|
| 2,047,436 | 7/1936 | Shepherd | 404/6 |
| 3,211,260 | 10/1965 | Jackson . | |
| 3,307,832 | 3/1967 | Van Zelm et al. . | |
| 3,377,044 | 4/1968 | Jackson et al. . | |
| 3,643,924 | 2/1972 | Fitch | 256/13.1 |
| 3,672,657 | 6/1972 | Young et al. | 267/116 |
| 3,674,115 | 7/1972 | Young et al. | 188/1 B |
| 3,845,936 | 11/1974 | Boedecker, Jr. et al. | 256/1 |
| 3,944,187 | 3/1976 | Walker | 256/13.1 |
| 3,982,734 | 9/1976 | Walker | 256/13.1 |
| 4,160,561 | 7/1979 | Farnam et al. | 293/1 |
| 4,352,484 | 10/1982 | Gertz et al. | 256/13.1 |
| 4,399,980 | 8/1983 | van Schie | 256/13.1 |
| 4,452,431 | 6/1984 | Stephens et al. | 256/13.1 |
| 4,583,716 | 4/1986 | Stephens et al. | 256/13.1 |
| 4,655,434 | 4/1987 | Bronstad | 256/13.1 |
| 4,784,515 | 11/1988 | Krage et al. | 404/6 |
| 4,815,565 | 3/1989 | Sicking et al. | 188/32 |
| 4,838,523 | 6/1989 | Humble et al. | 256/13.1 |

FOREIGN PATENT DOCUMENTS 3705485 9/1988 Fed. Rep. of Germany .

OTHER PUBLICATIONS

"Dragnet" Vehicle Safety Barrier System, Energy Absorption Systems, Inc. Catalog No. 8-OD.

Drawing "Crash-Cushion Attenuating Terminal" Syro Steel Company Girard, Ohio and Centerville, Utah.

Drawing "Guardrail Extruder Terminal" GET-89 State Department of Highways and Public Transportation.

Table III-B-4. Operational Roadside Barrier End Treatments.

*Primary Examiner*—Ramon S. Britts

*Assistant Examiner*—Gay Ann Spahn

*Attorney, Agent, or Firm*—Willian Brinks Olds Hofer Gilson & Lione

[57] ABSTRACT

A vehicle crash barrier for decelerating a vehicle that has left a roadway includes an elongated frame having a number of sections including a front section and at least one additional section arranged end to end along an axial direction. The frame is configured to collapse when axially struck on the front section by a vehicle. A wire cable extends generally parallel to the frame and has a forward end portion anchored independently of the frame and a rearward end portion. Friction brakes are mounted to the front section for engaging the wire cable to generate a retarding force to decelerate a vehicle as the brake moves along the wire cable during collapse of the frame following impact of the vehicle against the front section. Each section includes a pair of side panels, and axially adjacent side panels are connected by a flexible tension strap by fasteners. The tension strap operates to peel the fasteners out of the side panels during axial collapse. The front section is releasably secured to a ground anchor by a directionally sensitive breakaway assembly.

43 Claims, 10 Drawing Sheets

G
B
P
18
16
12
10
14
30
46
44
42
32
34
38
36
40
122
92
94
52
50
54
56

122
140
38
42
36
34
156
140
130
42
30
14
32
122
38
3.
44
34
3.
36
44
40
114
100

42
56
54
50
45
52
4.
4.
45
16.
42
122
32
38
36
140
34

5.
5.
P
128
B
P
B
P
122
54
52
42
45
50

FIG.6
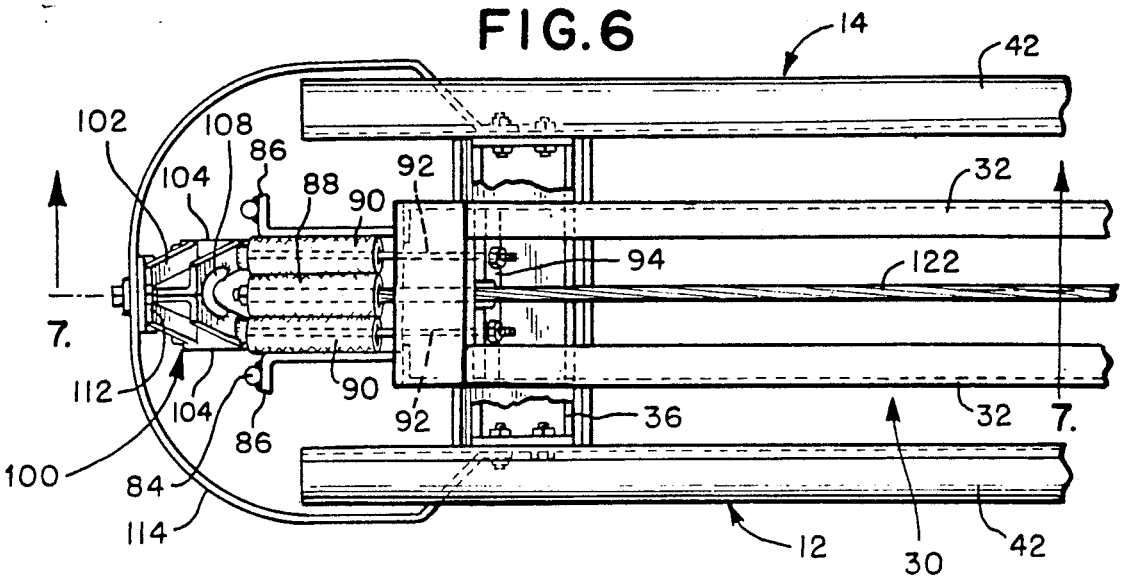
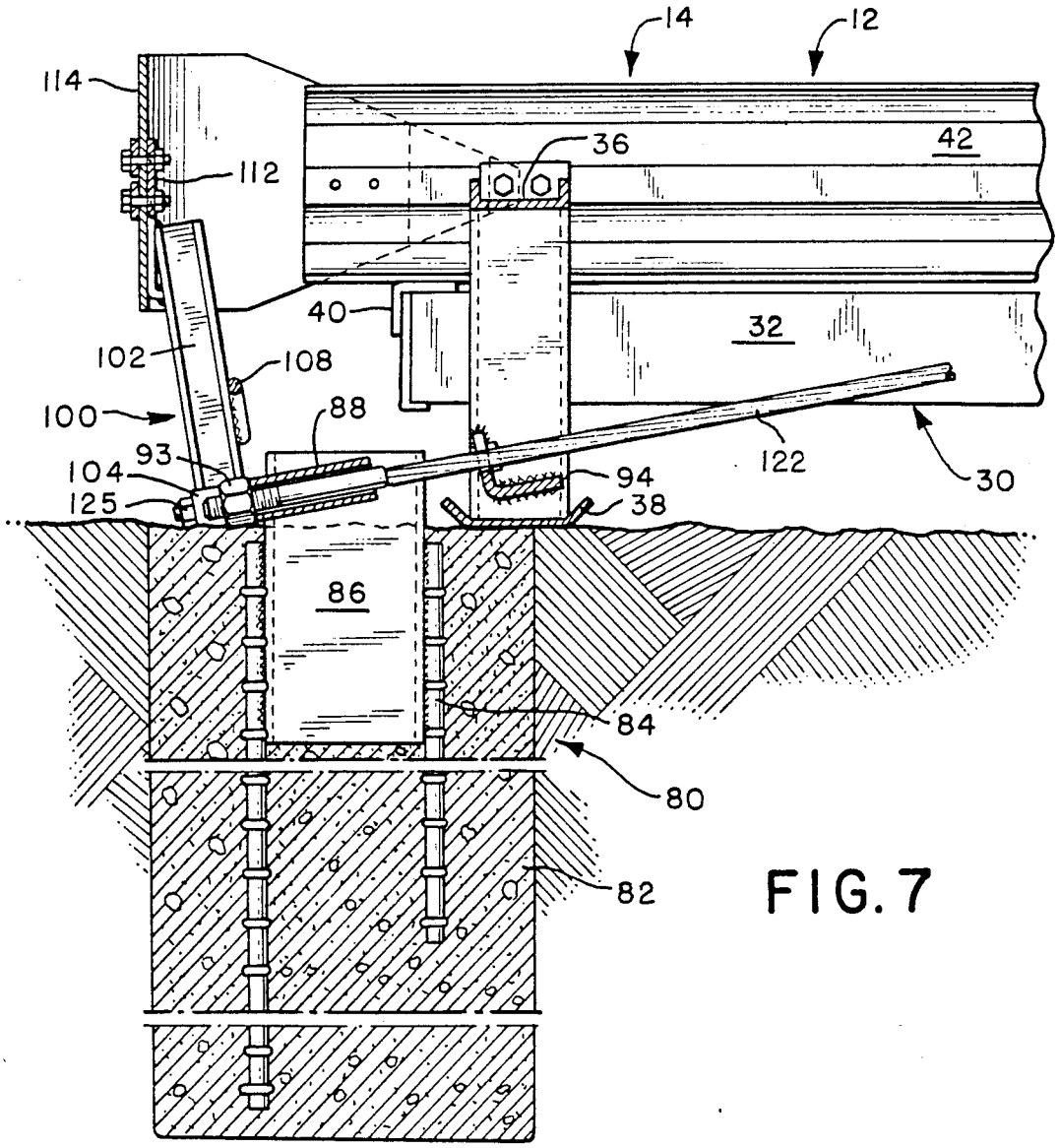
FIG.7

140
145
144
142
122
136
120
126
128
152
150
134
132
130
125
124
136,138
156

VEHICLE CRASH BARRIER

CROSS REFERENCE TO RELATED APPLICATION

This application is a continuation-in-part of U.S. patent application Ser. No. 07/439,654, filed Nov. 20, 1989 now abandoned.

BACKGROUND OF THE INVENTION

This invention relates to an improved vehicle crash barrier for decelerating a vehicle that has left a roadway.

Crash barriers are commonly employed alongside roadways to stop a vehicle that has left the roadway in a controlled manner, so as to limit the maximum deceleration to which the occupants of the vehicle are subjected. Additionally, such crash barriers can be struck from the side in a lateral impact, and it is important that the crash barrier have sufficient strength to redirect a laterally impacting vehicle.

A number of prior art approaches have been suggested for such crash barriers employing an axially collapsible frame having compression resistant elements disposed one behind the other in the frame. Young U.S. Pat. No. 3,674,115, assigned to the assignee of the present invention, provides an early example of one such system. This system includes a frame made up of an axially oriented array of segments, each having a diaphragm extending transverse to the axial direction and a pair of side panels positioned to extend rearwardly from the diaphragm. Energy absorbing elements (in this example water filled flexible cylindrical elements) are mounted between the diaphragms. During an axial impact the diaphragms deform the energy absorbing elements, thereby causing water to be accelerated to absorb the kinetic energy of the impacting vehicle. Axially oriented cables are positioned on each side of the diaphragms to maintain the diaphragms in axial alignment during an impact.

Other examples of such crash barriers are shown in Walker U.S. Pat. No. 3,944,187 and Walker U.S. Pat. No. 3,982,734, both assigned to the assignee of this invention. These systems also include a collapsible frame made up of an axially oriented array of diaphragms with side panels mounted to the diaphragms to slide over one another during an axial collapse. The barriers of these patents use a cast or molded body of vermiculite or similar material or alternately loosely associated vermiculite particles to perform the energy absorption function. Obliquely oriented cables are provided between the diaphragms and ground anchors to maintain the diaphragms in axial alignment during a lateral impact.

Gertz U.S. Pat. No. 4,352,484, also assigned to the assignee of the present invention, discloses an improved crash barrier that utilizes an energy absorbing cartridge made up of foam filled hexagonal lattices arranged to shear into one another in response to the compression forces applied to the energy absorbing cartridge by an impacting vehicle.

Stevens U.S. Pat. No. 4,452,431, also assigned to the assignee of the present invention, shows yet another collapsible crash barrier employing diaphragms and side panels generally similar to those described above. This system also uses axially oriented cables to maintain the diaphragms in axial alignment, as well as breakaway cables secured between the front diaphragm and the ground anchor. These breakaway cables are provided with shear pins designed to fail during an axial impact to allow the frame to collapse. The disclosed crash barrier is used with various types of liquid containing and dry energy absorbing elements.

VanSchie U.S. Pat. No. 4,399,980 discloses another similar crash barrier which employs cylindrical tubes oriented axially between adjacent diaphragms. The energy required to deform these tubes during an axial collapse provides a force tending to decelerate the impacting vehicle. Cross-braces are used to stiffen the frame against lateral impacts, and a guide is provided for the front of the frame to prevent the front of the frame from moving laterally when the frame is struck in a glancing impact by an impacting vehicle.

All of these prior art systems are designed to absorb the kinetic energy of the impacting vehicle by compressively deforming an energy absorbing structure. Because of the potential instability of compressive deformation, these systems use structural members to resist side forces that develop from compression loading. Furthermore, all use sliding side panels designed to telescope past one another during an impact. Because such sliding side panels must slide past one another during an axial impact, they have a limited strength in compression. This can be a disadvantage in some applications.

Another prior art system known as the Dragnet System places a net or other restraining structure transversely across a roadway to be blocked. The two ends of the net are connected to respective metal ribbons, and these metal ribbons pass through rollers that bend the ribbons as they pay out through the rollers during a vehicle impact. The energy required to deform these ribbons results in a kinetic energy dissipating force which decelerates the impacting vehicle. The general principle of operation of the metal deforming rollers is shown for example in Jackson U.S. Pat. Nos. 3,211,620 and 3,377,044 as well as Vanzelm U.S. Pat. No. 3,307,832. The Dragnet System utilizes the metal ribbons in tension, but it is not well suited for use alongside a roadway because metal bending systems are positioned on both sides of the roadway, and the net or other obstruction extends completely across the roadway.

Krage U.S. Pat. No. 4,784,515, assigned to the assignee of this invention, describes a collapsible guard rail end terminal that utilizes a wire cable extending through grommets in legs of the end terminal. The side panels of the end terminal are mounted to slide over one another when struck axially. When the end terminal collapses during an impact, the legs may be rotated such that the grommets work the cable and create a frictional force on the cable. However, the magnitude of the resulting retarding forces is highly variable, due to the variable and unpredictable rotational positions of the legs during the collapse.

Thus, a need presently exists for an improved highway crash barrier that provides predictable decelerating forces to an axially impacting vehicle, that is low in cost, that is simple to install, that utilizes a minimum of cross-bracing of the type required in the past to resist lateral impacts, and that efficiently redirects laterally impacting vehicles.

SUMMARY OF THE INVENTION

According to this invention, a vehicle crash barrier for decelerating a vehicle is provided comprising an elongated frame having a plurality of sections, including a front section and at least one additional section arranged end to end along an axial direction. The frame is configured to collapse axially when struck axially on the front section by a vehicle. A tension member is positioned generally parallel to the frame and has a forward end portion anchored independently of the frame and a rearward end portion. Brake means mounted in the frame, resiliently bias a brake member against the tension member to generate a frictional retarding force to decelerate a vehicle as the brake means moves along the tension member during collapse of the frame following impact of the vehicle against the front section.

Because the retarding force is provided by the interaction between the brake means and the tension member and the tension member is anchored at its forward end portion, the barrier of this invention operates with the tension member in tension rather than compression. This substantially eliminates the need for additional ground anchors and the like which can complicate installation. The resiliently biased brake member as described below has been found to provide a retarding force which remains surprisingly constant as the velocity of the brake member varies and it moves along the tension member. Additionally, this retarding force varies surprisingly little, even though the surface of the tension member may be contaminated with dirt, water, ice, and lubricants.

In this embodiment, the brake means includes an abrading material such as aluminum which is used in a friction generating sleeve in contact with the tension member. This approach is believed to be particularly effective in providing a predictable deceleration force under a variety of environmental conditions. Because the sleeve is resiliently biased against the tension member, the sleeve functions properly even after a transient force (such as that created by a protrusion on the tension member) has momentarily forced the sleeve away from the tension member.

In order to provide a crash barrier that is particularly effective against lateral impacts, the preferred embodiment described below additionally utilizes means for anchoring the rearward end portion of the tension member and means for coupling the frame to the tension member at a plurality of spaced locations along the frame such that the tension member reenforces the frame against undesired rotation about the axial direction during lateral impacts.

The embodiment described below employs frame sections, each having a pair of spaced side panels, one on each side of the tension member. A plurality of straps are provided, and these straps are secured to the side panels with fasteners such that each strap interconnects a respective pair of axially adjacent side panels. The side panels and straps are configured to pull the fasteners out of at least one of the side panels and the straps in response to axial movement of the frame when the vehicle axially impacts the front section, thereby disconnecting the respective axially adjacent sections to allow the frame to collapse axially.

This aspect of the invention allows the side panels to remain securely fastened together during a lateral impact while still accommodating axial collapse. The system described below actually peels the fasteners out of the side panels as the side panels telescope axially. This aspect of the invention is not limited to crash barriers having brake means of the type described above. Rather, it can be used broadly in a wide variety of axially collapsing vehicle crash barriers, including the prior art systems discussed above.

Another important feature of this invention relates to an improved breakaway mechanism disposed at the forward end of the frame. The front section of the frame is coupled by at least one fastener to a ground anchor to releasably anchor the front section in place. A release member is provided having a first end positioned to be moved by an axially impacting vehicle and a second end coupled to the fastener to release the fastener when the first end is moved by an axially impacting vehicle. This release member is positioned and configured to avoid releasing the fastener when the barrier is struck by a laterally impacting vehicle. Preferably, the release member defines a fulcrum that bears against a reaction surface, and the fulcrum is positioned closer to the second end than the first end such that the axially impacting vehicle pivots the release member about the fulcrum to part the fastener in order to release the front section. Once again, this aspect of the invention is not limited to crash barriers using brake means as described above, but can also be used with a wide variety of collapsible vehicle crash barriers, including the prior art systems described in the patents identified above.

Certain embodiments described below are bidirectional vehicle crash barriers adapted for use between two adjacent roadways, one carrying vehicles in a first direction and the other carrying vehicles in a second direction, oriented opposite the first direction. These bidirectional barriers include a collapsible frame comprising a plurality of sections including a front section, a plurality of middle sections, and a rear section, each of the sections comprising two side panels, each on a respective side of the frame, each side panel having a forward end nearer the front section and a rearward end nearer the rear section. The side panels on a first side of the frame overlap with the rearward ends of the side panels disposed outwardly to protect a vehicle moving toward the rear section from contact with the forward ends of the side panels on the first side. The side panels on a second side of the frame overlap with the forward ends of the side panels disposed outwardly to protect a vehicle moving toward the front section from contact with the rearward ends of the side panels on the second side. The frame includes a means for retarding axial collapse of the frame when the frame is struck by a vehicle axially on the front section to provide a decelerating force to the vehicle.

This bidirectional barrier operates to redirect a laterally impacting vehicle, whether it strikes the first or second sides of the barrier. The pattern of overlapping side panel is reversed on one side of the frame as compared with the other to accommodate the differing directions of traffic movement. These advantages are obtained without interfering with the ability of the frame to collapse on axial impact and to provide a decelerating force for a vehicle striking the front section. This aspect of the invention is not limited to use with the breaking means, the side panel securing means, or the breakaway mechanism described above. Rather, this aspect of the invention can readily be adapted for use with a wide range of prior art crash barriers, such as those described in the prior art patents discussed above.

The invention itself, together with further objects and attendant advantages, will best be understood by reference to the following detailed description, taken in conjunction with the accompanying drawings.

Figures 1, 3, 4, 5:
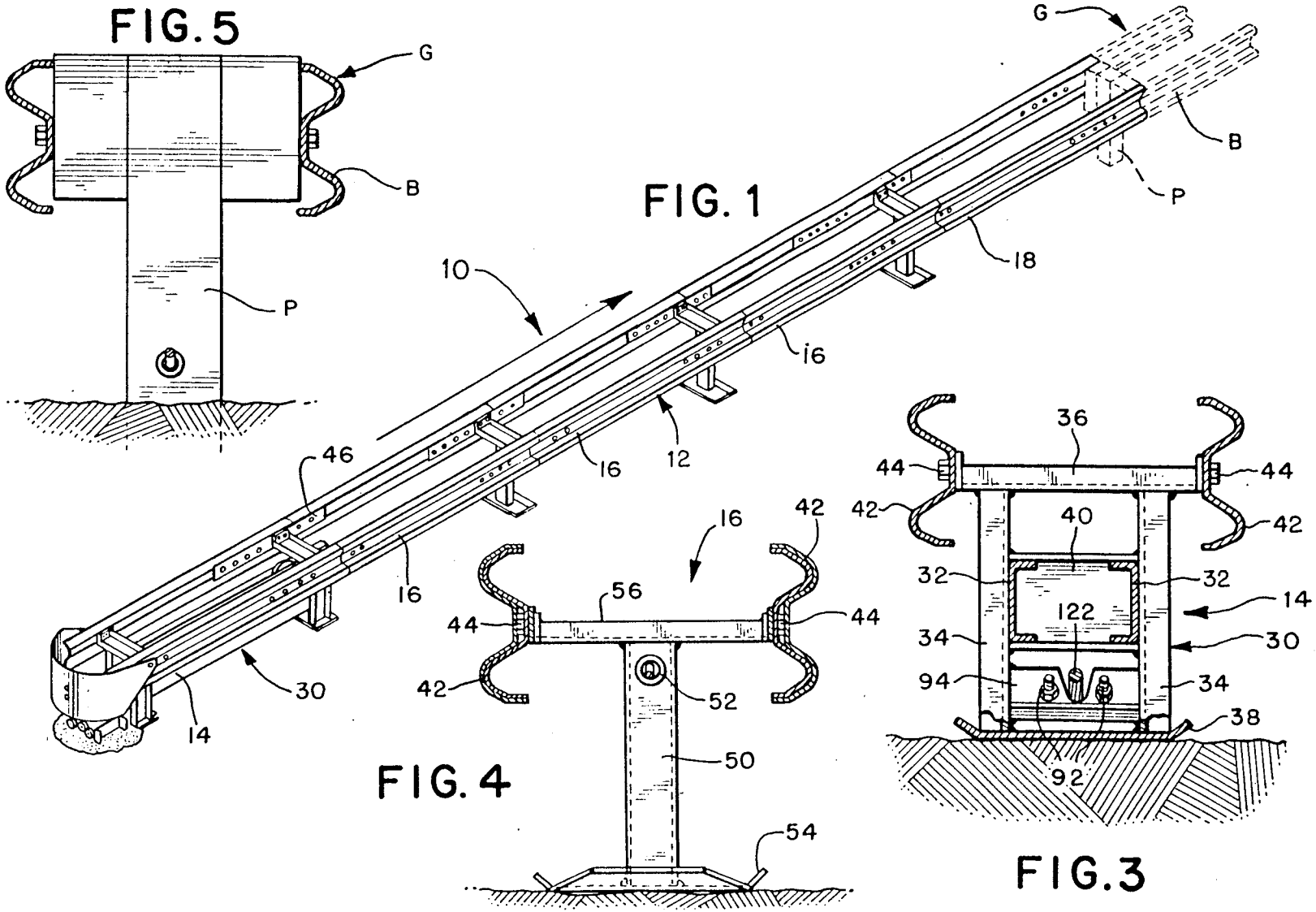
FIG. 1 is a perspective view of a vehicle crash barrier which incorporates the presently preferred embodiment of this invention.

FIGS. *2a, 2b* and *2c* are side elevational views of front, middle and rearward portions of the barrier of FIG. 1.

FIG. 3 is a cross-sectional view taken along line 3—3 of FIG. *2a*.

FIG. 4 is a cross-sectional view taken along line 4—4 of FIG. *2b*.

FIG. 5 is a cross-sectional view taken along line 5—5 of FIG. *2c*.

FIG. 6 is a top plan view of a front portion of the barrier of FIG. 1.

FIG. 7 is a cross-sectional view taken along line 7—7 of FIG. 6.

Figures 8, 9:
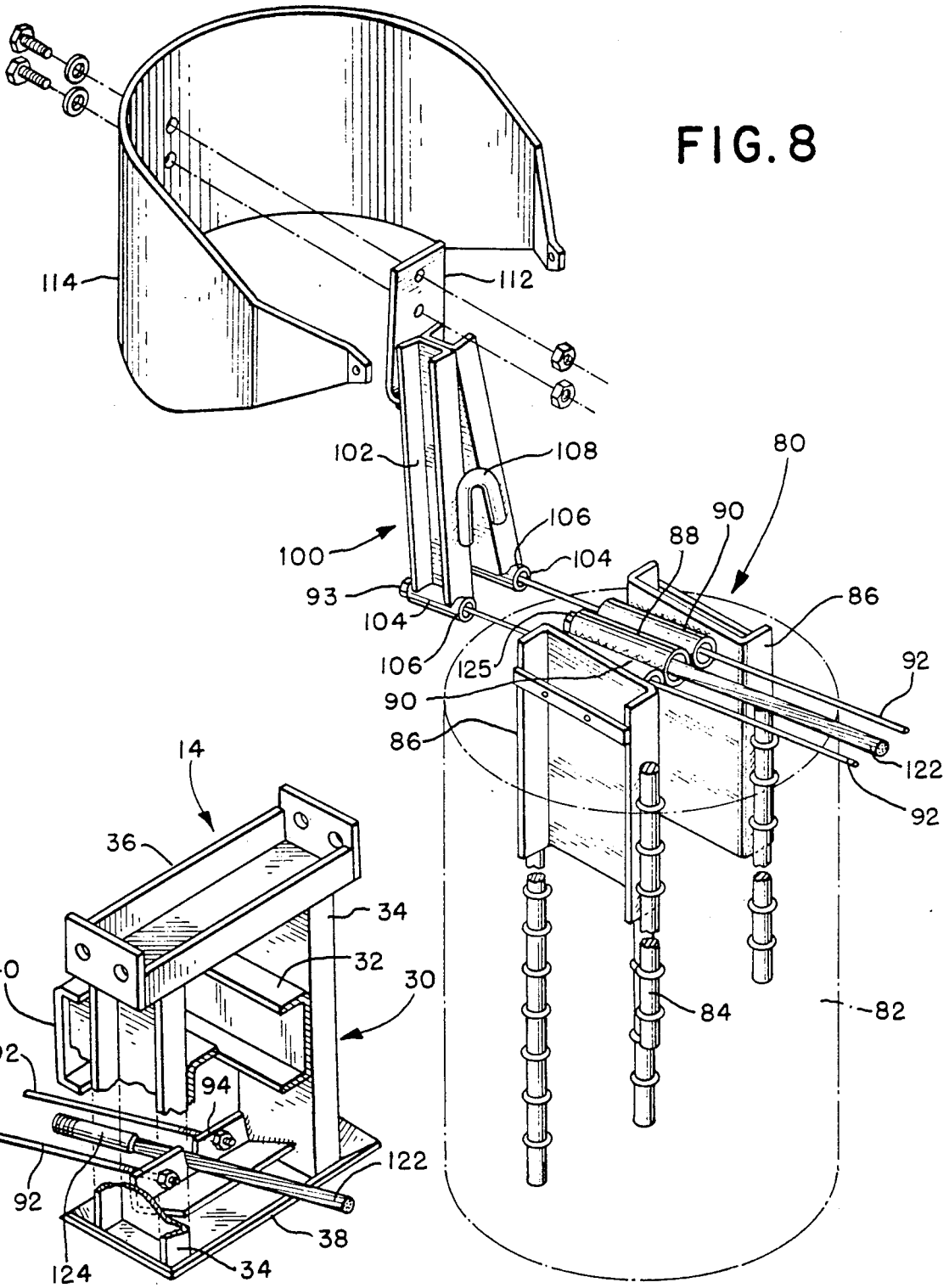

FIG. 8 is an exploded perspective view of selected elements shown in FIG. 7.

FIG. 9 is a fragmentary perspective view in partial cutaway of additional elements shown in FIG. 7.

Figures 10, 11, 12:
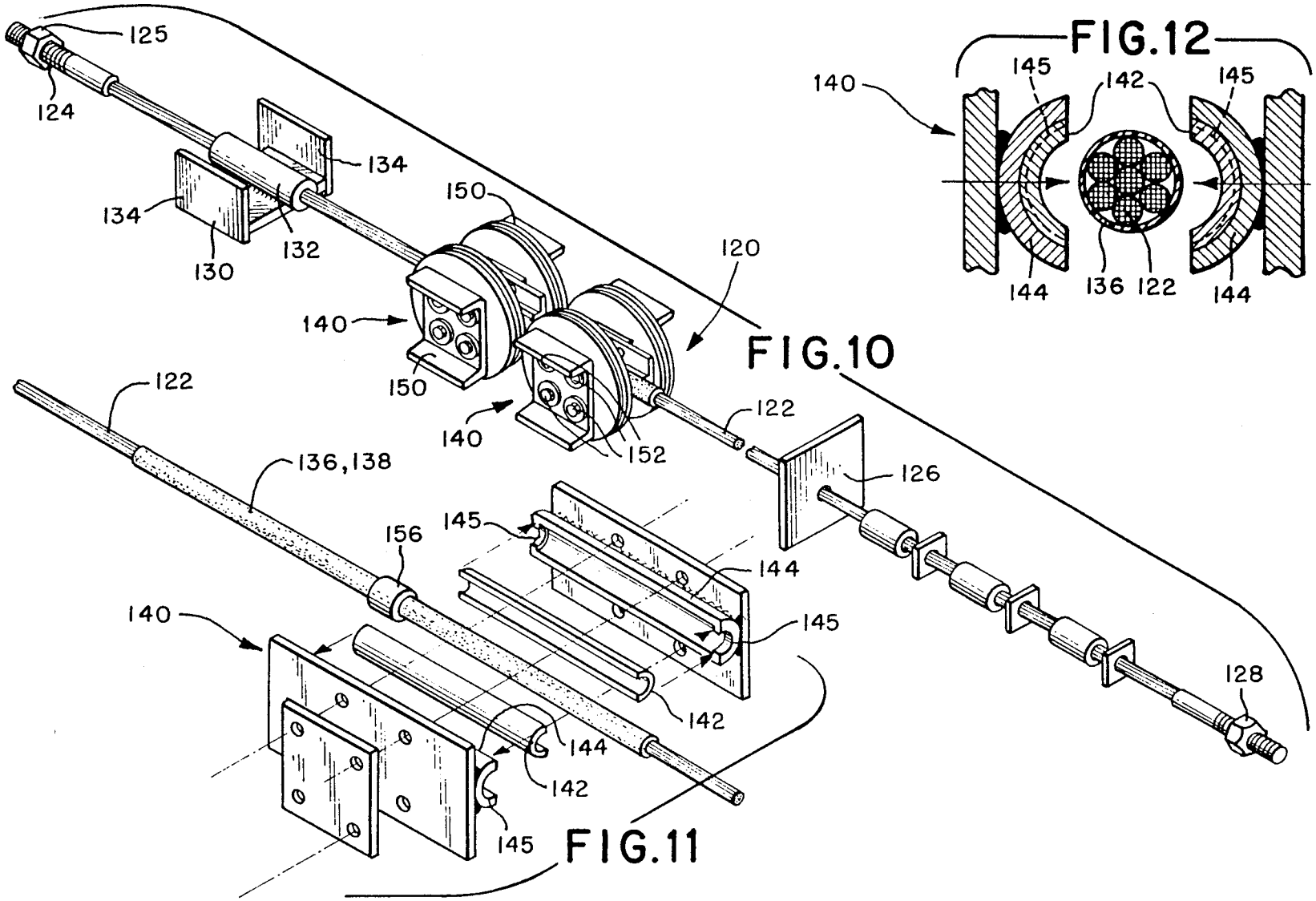

FIG. 10 is a perspective view of a wire cable, associated brake assemblies, and related elements of the barrier of FIG. 1.

FIG. 11 is an exploded perspective view of selected portions of one of the brake assemblies of FIG. 10.

FIG. 12 is an exploded cross-sectional view of selected elements of FIG. 11.

Figure 13:
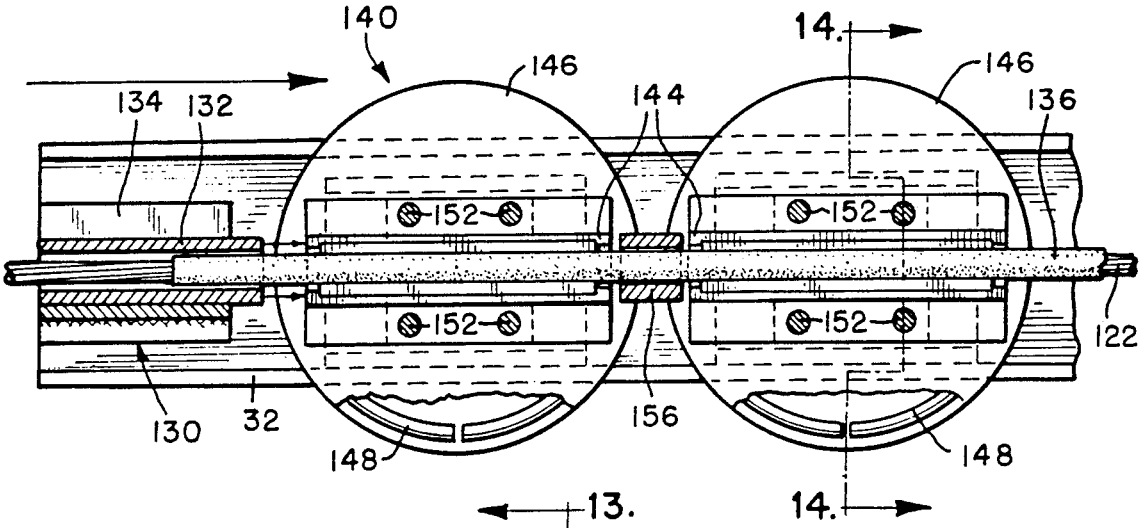
Figure 14:
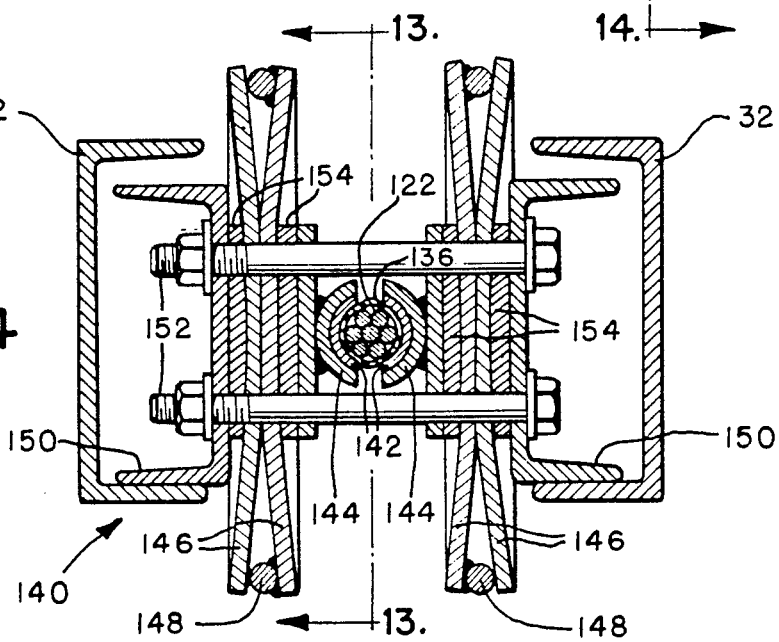

FIG. 13 is a cross-sectional view taken along line 13—13 of FIG. 14.

FIG. 14 is a cross-sectional view of one of the brake assemblies of FIG. 10, taken along line 14—14 of FIG. 13.

Figure 15:
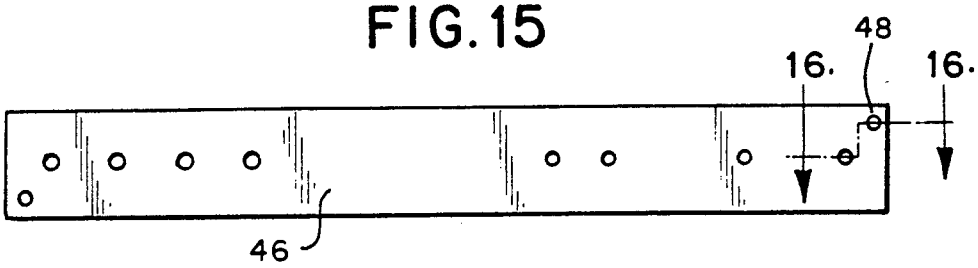

FIG. 15 is a plan view of one of the tension straps of the embodiment of FIG. 1.

Figure 16:
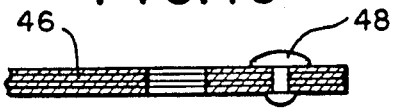

FIG. 16 is a partial sectional view taken along line 16—16 of FIG. 15.

Figure 17:
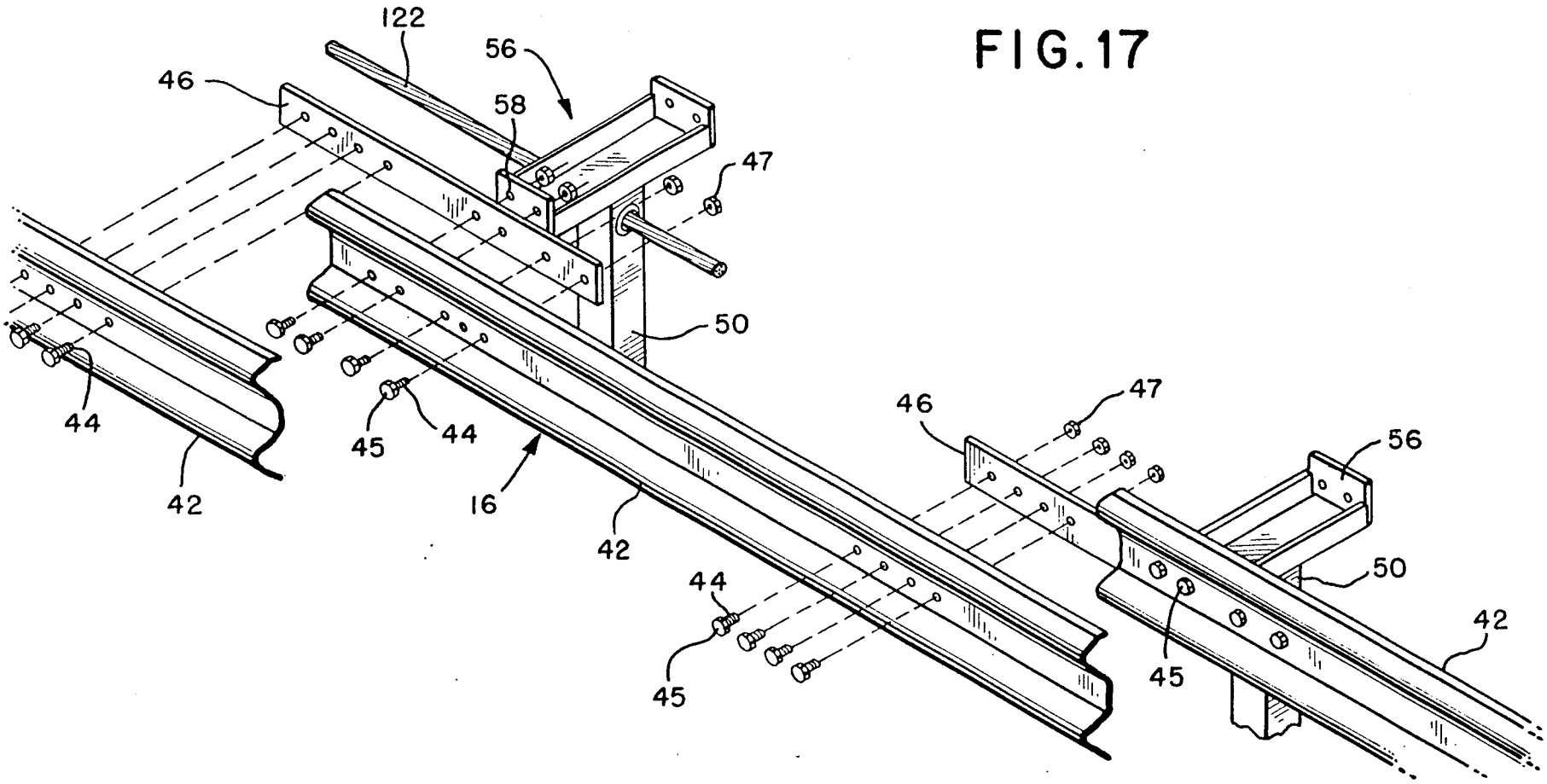

FIG. 17 is an exploded perspective view of portions of one of the middle sections of FIG. 1.

Figure 18:
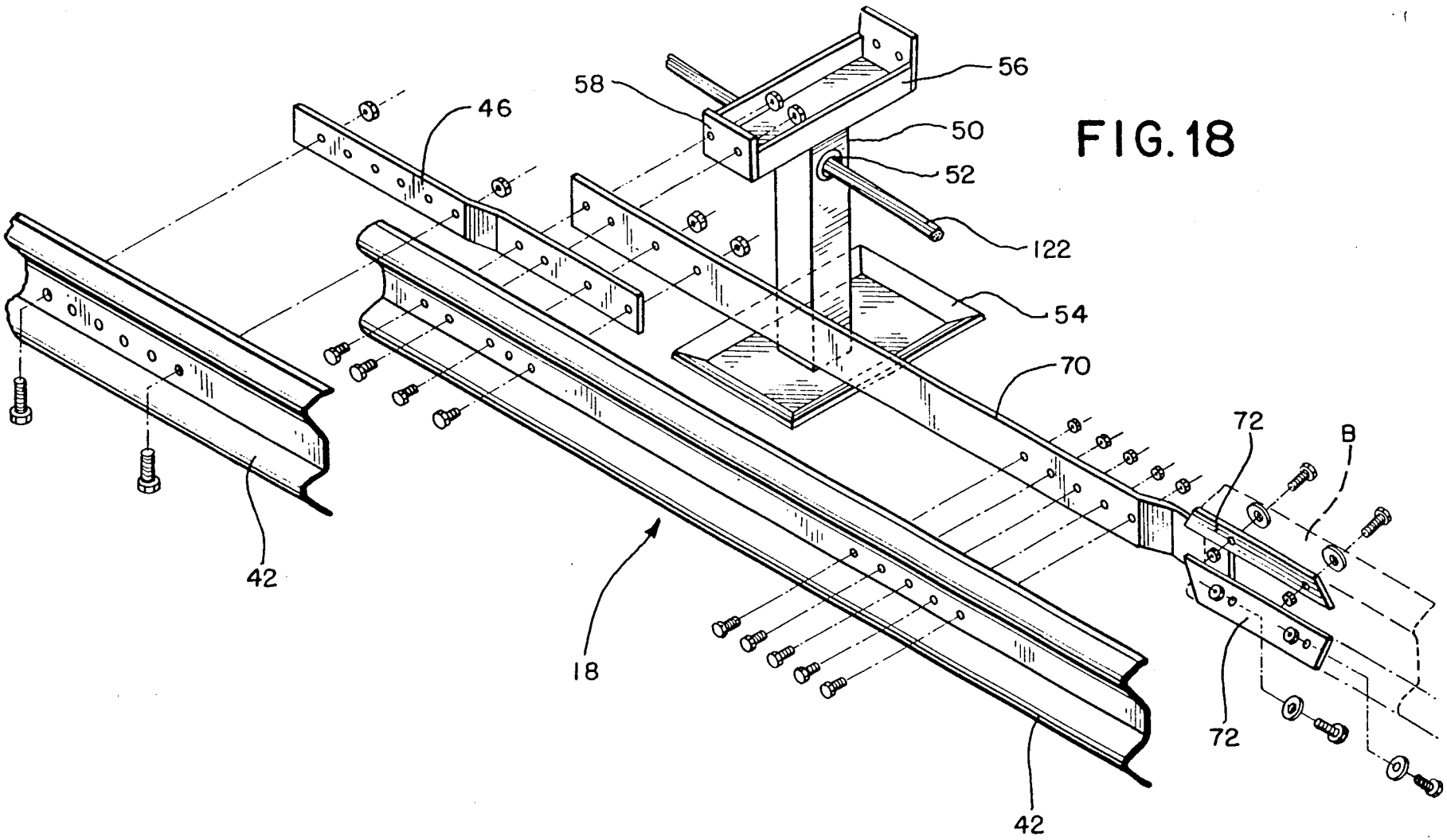

FIG. 18 is an exploded perspective view of portions of the rear section of FIG. 1.

FIGS. *19a–19c* are schematic views showing three stages in the axial collapse of the crash barrier of FIG. 1.

Figure 20:
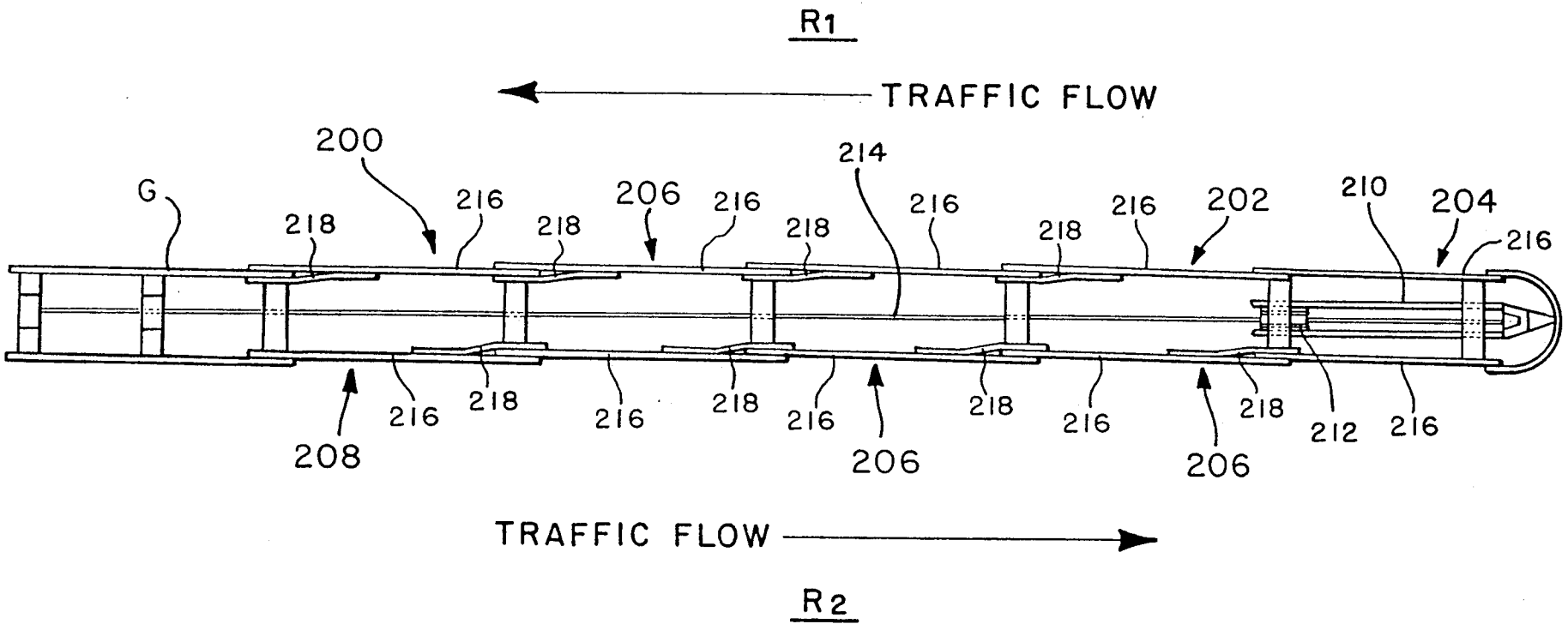

FIG. 20 is a schematic top view showing a bidirectional vehicle crash barrier which is formed of the components shown in the preceding figures.

DETAILED DESCRIPTION OF THE PRESENTLY PREFERRED EMBODIMENTS

Turning now to the drawings, FIG. 1 shows a perspective view of a crash barrier 10 which incorporates the presently preferred embodiment of this invention. The crash barrier 10 is typically positioned alongside a roadway (not shown) having traffic moving in the direction of the arrow. The crash barrier 10 is shown as mounted to the end of a conventional guard rail G, which can be for example of the type having wooden posts P supporting conventional guard rail beams B. As shown in FIG. 1, the crash barrier 10 includes a frame 12 which is axially collapsible and includes a front section 14, three middle sections 16 and a rear section 18. The rear section 18 is secured to the guard rail G as described below. As used herein the term "axial direction" means a direction aligned with the length axis of the crash barrier 10, generally parallel to the arrow indicating traffic flow in FIG. 1. The following discussion will first describe the frame 12, and then the breakaway assembly, cable assembly, and brake assemblies of the crash barrier 10.

Turning to FIGS. *2a* and 3, the front section 14 includes a substantially rigid brake support frame 30. This brake support frame 30 includes a pair of horizontal guide members 32 which are oriented axially. The horizontal guide members 32 are held fixedly in place by four vertical support members 34 arranged in pairs. Each pair is supported at its top by a cross-brace 36 and its bottom by a base plate 38. Each base plate 38 is provided with upwardly oriented edge panels to facilitate sliding of the base plate 38 across the ground without snagging. The forward ends of the horizontal guide members 32 are bridged by an end cap 40 which is rigidly secured in place to close off the space between the horizontal guide members 32. Two side panels 42 are secured to the forward cross-brace 36 by fasteners 44. The rearward ends of the side panels 42 are secured to axially adjacent side panels 42 in the next rearward section by tension straps 46 (FIG. 1), as described in detail below. The brake support frame 30 is intended to move across the ground as a substantially rigid framework during at least the initial portion of an axial collapse.

FIGS. *2b* and 4 show one of the middle sections 16. As shown in FIG. 4, each of the middle sections 16 includes a vertically oriented leg 50 which defines a pipe grommet 52 centrally located near the upper end of the leg 50. The lower end of the leg 50 is secured to a base plate 54 which once again is shaped to facilitate sliding of the base plate 54 across the ground. The upper end of the leg 50 is secured to a cross-brace 56 which defines fastener receiving openings 58 (FIG. 17). Two side panels 42 are secured to the respective sides of each of the cross-braces 56 by fasteners 44.

FIG. 17 shows the manner in which axially adjacent side panels 42 are interconnected by means of a tension strap 46. Each tension strap 46 defines two sets of four openings. The four openings near the front of the tension strap 46 are secured by fasteners 44 to the rearward end of a first side panel 42. The four openings near the rear of the tension strap 46 are secured to the forward end of a second side panel 42. Additionally, two of the fasteners secured to the forward end of the second side panel 42 are fastened to the openings 58 in order to secure the side panel 42 to the cross-brace 56. Each of the fasteners 44 comprises an outwardly facing hex head 45 and an inwardly facing threaded nut 47.

For reasons discussed in detail below, each of the tension straps 46 is preferably a flexible strap made up of a lamination of four separate plates secured together at each end by a rivet 48 (FIGS. 15 and 16). As discussed below, by making the tension straps 46 flexible, the frame 12 is allowed to collapse axially in a controlled manner, while still retaining significant strength to withstand lateral impacts.

FIG. 18 shows an exploded perspective view of the rear section 18 which is secured to a transition strap 70. The transition strap 70 is in turn secured by fasteners and plates 72 to the forward-most end of the beam B of the guardrail.

The frame 12 described above is not secured to the ground in any way, and is simply secured to the guard rail G by the transition strap 70 and plates 72. In order to position the front section 14 properly, a front anchor assembly 80 is provided, as shown in FIGS. 6–8. This front anchor assembly 80 includes a concrete pile 82. A box structure 84 of reinforcing bars is anchored in the pile 82, and the upper end of this box structure 84 supports two C channels 86. Three tubes including a larger central tube 88 and a pair of smaller side tubes gO are rigidly secured, as for example by welding, between the C channels 86. As shown in FIG. 8, the tubes 88, 90 are oriented axially and tilted slightly such that the front ends are lower than the rearward ends.

As shown in FIGS. 6 and 8, the side tubes 90 are used to secure the front section 14 to the front anchor assembly 80 by means of bolts 92. These bolts 92 are secured at their rearward ends to an angle 94 rigidly mounted on the front vertical support members 34 of the brake support frame 30 (FIG. 9). These bolts 92 pass through the side tubes 90 and are held in place by nuts 93 (FIGS. 7 and 8). The front anchor assembly 80 serves to anchor the front end of the frame 12 when the frame 12 is struck laterally by an impacting vehicle moving obliquely with respect to the axial direction.

Of course, for the crash barrier 10 to operate as intended, it is important that the frame 12 be released from the front anchor assembly 80 during an axial impact. This function is performed by a breakaway assembly 100, as best shown in FIGS. 6–8. This breakaway assembly 100 includes a lever arm 102 which terminates at its lower end in a pair of tubes 104. Each of the tubes 104 defines a fulcrum 106 adjacent its upper edge, where it bears against a reaction surface formed by the respective side tube 90. As shown in FIG. S, the lever arm 102 is generally V-shaped, and a C-shaped guide 108 is provided to guide the lever arm 102 as it moves axially along a wire cable during collapse of the frame 12. The upper end of the lever arm 102 is rigidly secured to a plate 112, which is in turn secured by fasteners to a nose plate 114. The nose plate 114 is generally C-shaped, and is secured by fasteners at its rearward edges to the front cross-brace 36 of the brake support frame 30.

As shown in FIG. 7, the lever arm 102 is oriented obliquely with respect to the vertical direction, with its upper end positioned forwardly of its lower end. During an axial impact, the impacting vehicle contacts the nose plate 114 and pushes the plate 112 rearwardly. This pivots the lever arm 102 about the fulcrum 106, providing a large elongating force which parts the bolts 92. Once the bolts 92 are parted, the brake support frame 30 is released from the front anchor assembly 80, and the frame 12 is free to collapse axially as it decelerates the impacting vehicle.

It is important to recognize that the breakaway assembly 100 responds preferentially to an axial impacting force to part the bolts 92. If the nose plate 114 is struck at a large oblique angle, or if the frame 12 is struck obliquely along its length, the lever arm 102 does not pivot around the fulcrum 106, and the breakaway assembly 100 does not function as described above. This direction specific characteristic of the breakaway assembly 100 provides important advantages.

FIG. 10 provides a view of a cable assembly 120 included in the crash barrier 10. This cable assembly 120 includes a tension member such as a wire cable 122 that is provided with threaded bolts 124, 128 at its forward and rearward ends. The forward bolt 124 passes through the central tube 88 of the front anchor assembly 80 and is secured in place by a nut 125, as shown in FIG. 8. The rear bolt 128 passes through an opening in one of the posts P (which serves as a rear ground anchor) and is likewise secured in place by a nut (FIG. 2*c*) such that the wire cable 122 is stretched between the front anchor assembly 80 and the post P that supports the rear bolt 128. A plate washer 126 is provided to spread the tension forces of the wire cable 122 on the post P. At intermediate points along the length of the wire cable 122, the wire cable 122 passes through the grommets 52 of the legs 50.

Figures 2A, 2B, 2C:
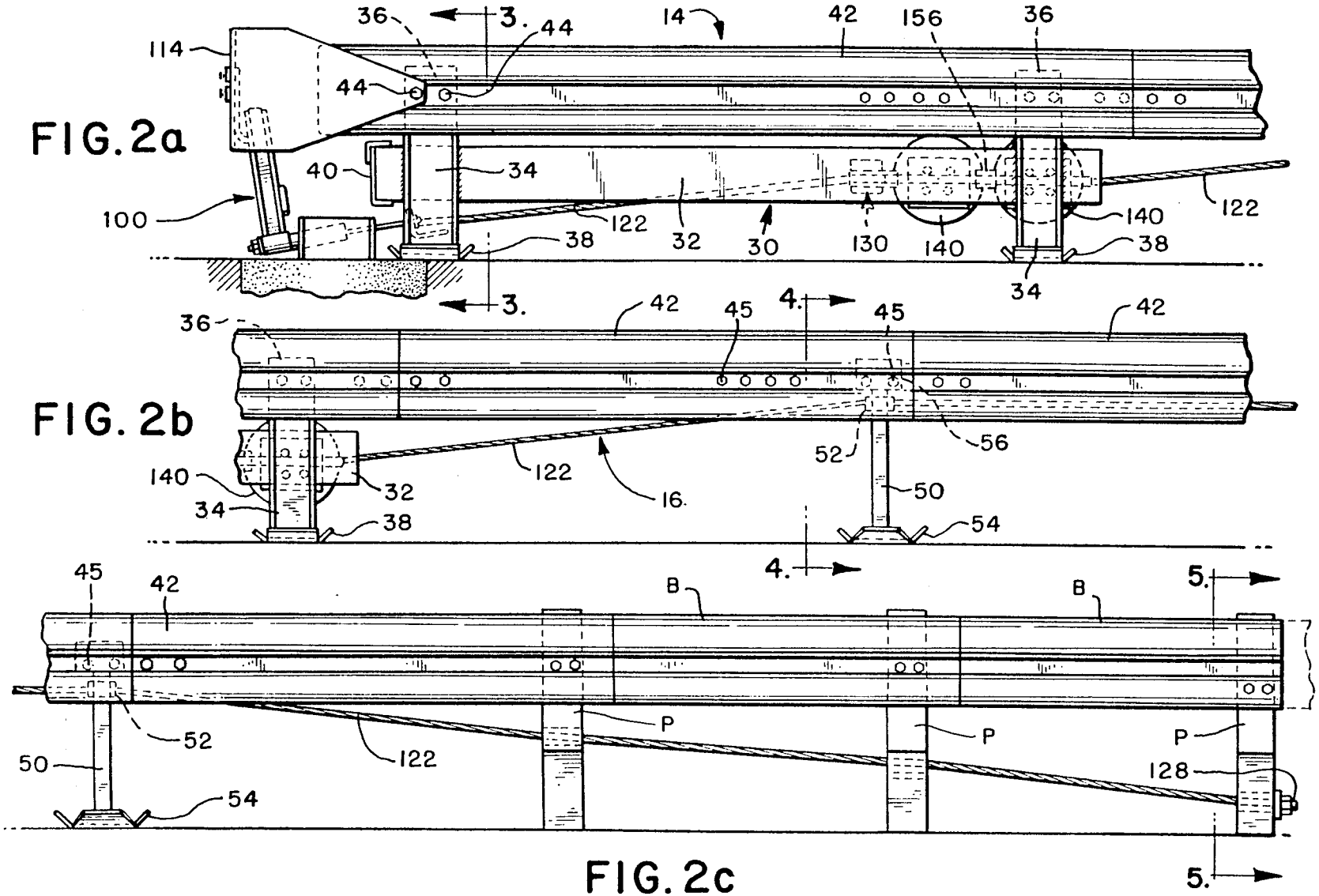

As shown in FIG. 10 a sliding stop 130 is mounted on the wire cable 122. This sliding stop 130 includes a central tube 132 interposed between two flanges 134. The flanges 134 are received within the horizontal guide members 32 such that the sliding stop 130 is slidable along the length of the brake support frame 30 (FIG. 2*a*). Additionally, a sleeve of low friction material 136 (FIG. 11) is applied to the wire cable 122 for a short distance near the rearward end of the horizontal guide members 32, for reasons described below. Additionally, this low friction material 136 can be lubricated with a lubricant 138.

The crash barrier 10 includes two brake assemblies 140, best shown in FIGS. 11–13. The brake assemblies 140 each include a pair of brake sleeves 142 shaped to fit around and engage the wire cable 122. The brake sleeves are preferably made of an abradable material such as aluminum. The sleeves 142 are positioned inside respective sleeve clamps 144 which include retaining shoulders 145 positioned to prevent the sleeves 142 from moving axially out of the sleeve clamps 144. A pair of spring plates 146 are provided on each side of the brake assembly 140, and these spring plates 146 are separated at their periphery by a spacer ring 148 (FIGS. 13 and 14). A pair of guides 150 made of C section channels are mounted at the sides of each brake assembly 40. As shown in FIGS. 10 and 13, the entire assembly is held together by four fasteners 152. Spacer plates 154 are provided on each side of the spring plates 146. When brake assembly 140 is fully assembled with the fasteners 152 tightened as shown in FIG. 14, the spring plates 146 provide a resilient biasing force tending to hold the brake sleeves 142 against the wire cable 122. Thus, dimensional changes in the brake sleeves 142 as they are abraded do not substantially alter the force with which the brake sleeves 142 are pressed against the wire cable 122.

As shown in FIGS. 2*a* and 13, the two brake assemblies 140 are mounted in the horizontal guide members 32 of the brake support frame 30, with the guides 150 allowing the brake assemblies 140 to move axially along the horizontal guide members 32. The sliding stop 130 is positioned on the wire cable 122 forward of the brake assemblies 140, and a tubular spacer 156 is positioned around the wire cable 122 between the brake assemblies 140 to bear on the sleeve clamps 144. Prior to impact, the brake assemblies 140 are positioned near the rearward end of the horizontal guide members 32, with the brake sleeves 142 of both of the brake assemblies 140 engaging the low friction material 136 on the wire cable 122 (FIG. 2*a*).

The following information is provided to define the best mode of this invention, and is no way intended to be limiting. In this embodiment the pile 82 is two feet in diameter and five feet in depth and the bolts 92 are $\frac{7}{8}$ inch diameter grade B threaded rods. The wire cable 122 in this embodiment is a 1 inch diameter 6 by 25 galvanized cable. The horizontal guide members 32 in this embodiment are 6 feet in length. This length provides control over objectionable rotational forces imposed by a car striking the crash barrier 10 obliquely. The brake support frame 30 provides protection for the brake assemblies 140 such that they are never struck by the vehicle.

In this embodiment, the legs 50 are spaced on six foot, three inch centers. The brake sleeves 142 can be made of aluminum alloy #6061-T6, which has been found to provide a high coefficient of friction and to provide an abrading surface so that hydrodynamic skating will not develop. The spring plates 146 are made of high strength steel such as AR400 plate, and are in this embodiment $\frac{3}{8}$ inch thick and $10\frac{1}{4}$ inch in diameter. The spring plates 146 are highly stressed, and should preferably be made of a material with a yield strength greater than 165,000 psi. The holes in the spring plates 146 are preferably drilled (not punched) and countersunk to reduce microfractures. The spring plates 146 preferably apply a resilient force of about 50,000 pounds biasing each sleeve 142 against the cable 122. The sleeves 142 are preferably $7\frac{1}{2}$ inches in length.

Preferably, the tension straps 46 are laminated from 14 gauge A-591 galvanized A-526 sheet steel, and the openings in the straps freely receive a standard $\frac{5}{8}$ inch diameter galvanized bolt. The fasteners 44 used to secure the straps 46 to the side panels 42 are preferably $\frac{5}{8}$ inch diameter bolts with standard hex heads 45 (without washers) positioned to the outside and standard hex nuts 47 (11/16 inch high and $1\frac{1}{4}$ inch between parallel faces, ASTM-A563, Central Fence Co., Sacramento, Calif.). The side panels 42 can be formed from 12 gauge cold rolled steel with punched 11/16 inch holes, and are preferably hot dip galvanized after fabrication per ASTM A-123. Knock outs may be provided in the side panels 42 at each end of each set of four holes to allow the fasteners 44 to be placed in any of three positions. In this way the effective length of the side panels 42 may be selected to suit the application.

In this embodiment, the horizontal guide members 32 are configured such that the brake assemblies 140 can move approximately 50 inches towards the front of the brake support frame 30 before the sliding stop 130 contacts the end plate 40. The low friction material 136 is preferably made from a sleeve of zinc or urethane plastic. The high pressure lubricant 138 can for example be graphite, molydisulfide or powdered metal. The openings in the tension straps 46 are precisely positioned to ensure that the four fasteners share the load and develop a 60,000 pound maximum tension. The flexibility of the tension straps 46 ensures that a relatively low force of about 5000 pounds is required to release the fasteners 44 from the tension straps 46 as described below.

OPERATION

When the crash barrier 10 is in its initial position as shown in FIGS. 1 and 2*a*, the brake assemblies 140 are positioned near the rearward end of the horizontal guide members 32, with the brake sleeves 142 on the low friction material 136 and the lubricant 138. When the frame 12 is struck axially by an impacting vehicle, the breakaway assembly 100 functions as described above to release the front section 14 from the front anchor assembly 80. Initially the brake support frame 30 moves rearwardly, and the brake assemblies 140 remain in position on the wire cable 122. When the brake support frame 30 has been moved rearwardly by a sufficient distance, the sliding stop 130 comes into contact with the end cap 40, thereby transmitting rearwardly directed forces to the brake assemblies 140. This causes the brake assemblies 140 to begin to slide along the wire cable 122.

The sliding stop 130 is shaped to bear directly on the sleeve clamps 142 of the forward brake assembly 140, and the sleeve clamps 142 of the forward brake assembly 140 transmit axial forces via the tubular spacer 156 directly to the sleeve clamps 142 of the rear brake assembly 140 (FIG. 13). This arrangement ensures that axial forces are applied to the brake assemblies 140 very near to the cable 122, and thereby minimizes any tendency of the brake assemblies to rotate with respect to the cable 122. The sliding stop 130 and the brake assemblies 140 are free to float a slight amount in the guide members 32, thereby further reducing any rotational torques applied to the brake assemblies 140. These features allow the brake assemblies 140 to remain aligned with the cable 122 to provide a more predictable, more nearly constant retarding force.

The low friction material 136 and the lubricant 138 cooperate to reduce the static coefficient of friction and to prevent the brake assemblies 140 from developing excessive retarding forces as they begin to slide along the wire cable 122. By allowing the brake assemblies 140 to remain stationary during the initial stages of an impact, maximum initial decelerating forces on the vehicle are reduced. The brake support frame 30 has a substantial mass, and the inertial forces required to accelerate the brake support frame 30 provide a substantial initial retarding force on the vehicle. On the system described above, the brake assemblies 140 do not contribute to the retarding force until after the brake support frame 30 has been substantially accelerated. This results in a lower peak decelerating force on the vehicle. The low friction material 136 and the lubricant 138 further reduce deceleration peaks associated with initial movement of the brake assemblies 140.

As the frame 12 collapses axially, the brake assemblies 140 are caused to slide along the length of the wire cable 122, and the brake sleeves 142 provide a large retarding force on the vehicle.

Figure 19A:
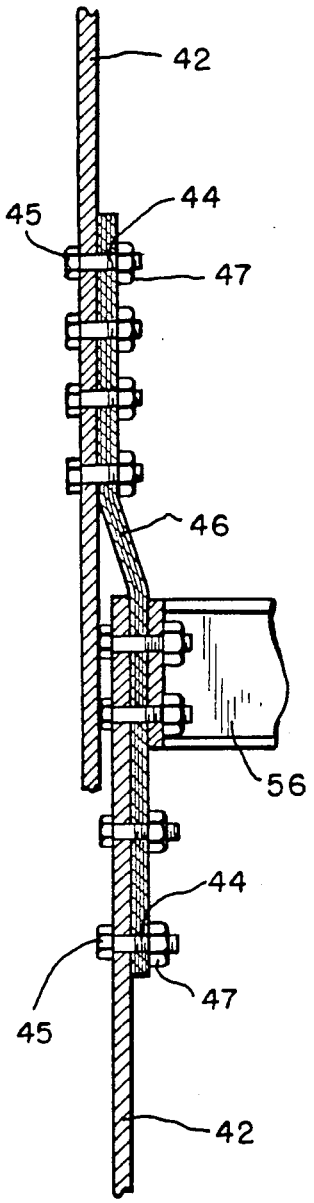
Figure 19B:
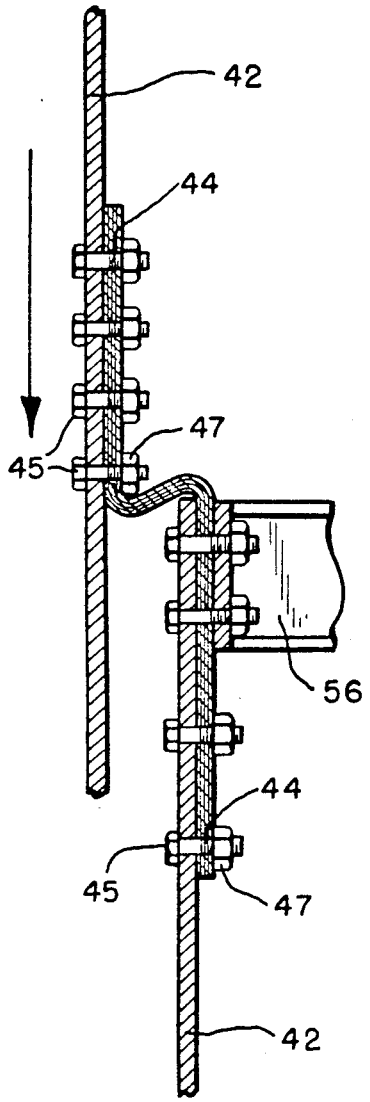
Figure 19C:
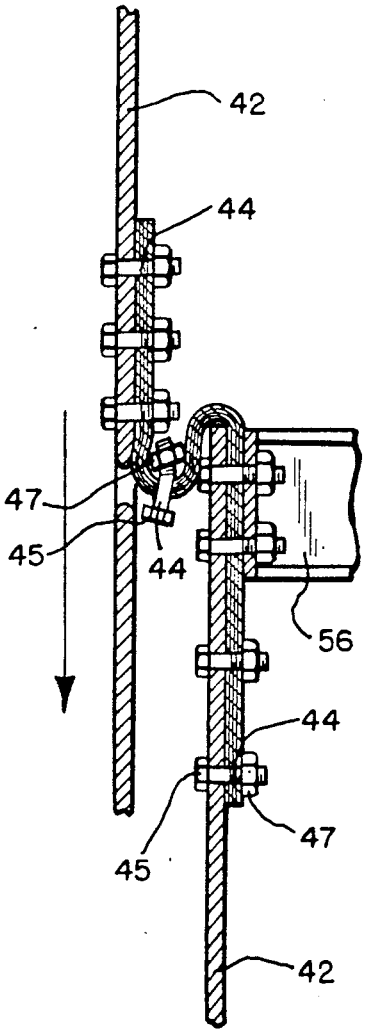

FIGS. 19*a*–19*c* show the manner in which the tension straps 46 allow axially adjacent side panels 42 to disengage from one another during the axial collapse of the frame 12. As shown in FIG. 19*a*, the side panels 42 are initially arranged in a fish scale pattern with the rearward ends of the side panels 42 disposed outwardly. The tension straps 46 are initially provided with a slight S shape. As axial forces on a side panel 42 increase, it tends to move rearwardly as shown in FIG. 19*b*, bending the tension strap 46 into a pronounced S shaped curve. As pointed out above, the tension straps 46 are made up of a lamination of individual plates to provide increased flexibility to encourage this effect. As the side panels 42 continue to collapse the tension strap 46 assumes the position shown in FIG. 19*b*, where substantial peeling forces are applied to an individual one of the fasteners 44. The fasteners 44 are provided without washers at their outer ends, and the heads 45 of the fasteners 44 peel through the side panel 42 one by one, as shown in FIG. 19*c*. In this way, the entire frame 12 can collapse axially in order to allow the brake assembly 140 to move along the wire cable 122.

The resiliently biased brake means described above have been found to provide a surprisingly constant retarding force in spite of variations in position and velocity of the brake means along the wire cable, and in spite of wide variations in the surface condition of the wire cable 122. In the preferred embodiment described above, the total stroke of the brake means is about 20 feet, and the retarding force supplied by the brake means is surprisingly constant at about 11,000 pounds. The spring plates 146 move to maintain the brake sleeves 142 in resilient contact with the wire cable 122, even as the brake sleeves 142 change in dimension as aluminum is abraded. Nevertheless, the retarding force remains substantially constant throughout the stroke. This is believed to be associated with the increasing temperature of the brake sleeves 142 resulting from frictional heating. The retarding force generated by the braking means has been found to vary little, even in the face of wide variations in the velocity of movement of the braking means along the cable.

Additionally, the retarding force generated by the braking means has been found to vary surprisingly little in spite of wide variations in the surface condition of the wire cable. Water, dirt, and even lubricants on the wire cable do not have a major effect on the retarding force after the braking means is moving along the wire cable.

In order to obtain optimum operation from the braking means, the braking sleeve should be formed of a suitable material. Preferably, the material should provide a high coefficient of friction, should be selected so as not to weld to the cable when heated, and not to work harden substantially during use so as to reduce friction. Aluminum alloys are preferred, and aluminum alloy #6061-T6 has been found particularly well suited for use in this embodiment.

The crash barrier 10 functions quite differently in a lateral impact. As pointed out above, in a lateral impact the breakaway assembly 100 does not release the front section 14 from the front anchor assembly 80. Furthermore, during a lateral impact the tension straps 46 operate in tension, and do not peel away the fasteners 44 as described above. For this reason, the side panels 42 are anchored at both their forward and rearward ends, and are able to support substantial compressive and tensile forces. Additionally, the wire cable 122 is anchored at its forward end to the front anchor assembly 80 and at its rearward end to the guard rail G. Intermediate of these two anchors the wire cable 122 passes through the grommets 52 to support the legs 50 against lateral movement and rotation. Taken together, the wire cable 122, the side panels 42, and the tension straps 46 insure that the crash barrier 10 has substantial lateral rigidity.

BIDIRECTIONAL EMBODIMENTS

FIG. 20 shows a bidirectional crash barrier 200 which incorporates a presently preferred embodiment of this invention. This bidirectional barrier 200 is shown mounted between two parallel roadways R1, R2. Each roadway carries traffic moving in the direction of the arrows. The bidirectional barrier 200 is shown mounted to the end of a guardrail G, which may be identical to that described above.

As shown in FIG. 20, the barrier 200 includes a collapsible frame 202 which is made up of a front section 204, several middle sections 206 and a rear section 208. The rear section 208 is secured to the end of the guardrail G. The frame 202 is made of the same components as those described above. The front section 204 includes a brake support frame 210 which is identical to the brake support frame 30 described above. The brake support frame 210 supports a plurality of brake assemblies 212 identical to the assemblies 140 described above. The brake assemblies 212 are designed to slide along a wire cable 214 as described above.

As before, each of the sections 204, 206, 208 has two sides, and a side panel 216 is mounted on each side of each section 204, 206, 208. Axially adjacent ones of the side panels 216 in this embodiment are connected together with tension straps 218 in the same manner as that described above. However, as shown in FIG. 20 the overlapping of the side panels 216 differs between the two sides of the frame 202. On the side of the frame 202 adjacent the roadway R1 the side panels 216 are arranged in the same configuration as the embodiment of FIG. 1. On the side of the frame 202 adjacent the roadway R2 the pattern of overlapping is reversed. Namely, on this second side the rearward ends of the side panels 216 are disposed inwardly (nearer the wire cable 214) and the forward ends of the side panels 216 are disposed outwardly (nearer the roadway R2). This arrangement ensures that vehicles travelling in the direction of the arrow on roadway R2 and striking the side panels 216 in a glancing blow are free to slide along the side panels 216 on the side of the frame 202 adjacent the roadway R2, protected from the rearward, inwardly disposed ends of the side panels 216. Similarly, vehicles travelling along the direction of the arrow on the roadway R1 are also free to slide along the side panels 216 on the side of the frame 202 adjacent the roadway R1, and are protected from undesirable contact with the forward ends of the side panels 216.

In the event of an axial impact of a vehicle on the roadway R1 against the front section 204, the axial rigidity of the brake support frame 210 in the front section 204 protects such a vehicle from being speared by one of the side panels 216 on the side of the frame 202 adjacent the roadway R2. As the middle sections 206 collapse, the forward ends of the side panels 216 on the side of the frame 202 adjacent the roadway R2 approach the impacting vehicle. However, the substantially rigid brake support frame 210 acts as a spacer, preventing the impacting vehicle from contacting and being speared by the forward ends of the side panels 216. The brake support frame 210 acts as a brace against axial collapse of the front section 204 and ensures that the front section 204 is more resistant to axial collapse than the middle sections 206. The design described above provides a front section 204 which is sufficiently resistant to axial collapse so as not to collapse in operation when struck by a vehicle of the maximum design weight travelling at the maximum design speed of the barrier 200.

The asymmetrical orientation of the side panel 216 causes the two sides of the frame 202 to collapse in a somewhat different manner. For example, during an axial collapse the side panels 216 on the upper side of the frame 202 adjacent the roadway R1 in FIG. 20 do not telescope with respect to one another between the front section 204 and the immediately adjacent middle section 206. In contrast, telescoping movement is accommodated between the side panels 216 on the lower side of FIG. 20 adjacent the roadway R2 between these two sections 204, 206. In order to accommodate this asymmetry, the side panel 216 on the upper side of FIG. 20 adjacent the roadway R1 that is secured to the guardrail G is secured by means of a tension strap 218 of the type described above, to permit telescoping therebetween. However, the side panel 216 on the lower portion of the rear section 208 (as shown adjacent the roadway R2 in FIG. 20) is fixedly secured to the second side of the guardrail G, to prevent any telescoping. The asymmetrical telescoping action at the front and rear ends of the collapsible frame 202 offset one another to provide an improved pattern of telescoping.

It will be understood that the bidirectional barrier of this invention can be implemented with a variety of approaches other than those described above. For example, frictional braking means are not required to create a retarding force for the axially impacting vehicle. Rather, any of the prior art approaches described in the patents discussed above can be substituted, including systems using a plurality of energy absorbing members positioned in the frame to retard axial collapse of the frame as a result of compressive deformation of the energy absorbing members. For example, the foam filled hexagonal lattices described in Gertz U.S. Pat. No. 4,352,484 or the deformable tubes shown in VanSchie U.S. Pat. No. 4,399,980 can be used in substitution for the frictional braking means shown in FIG. 20.

Furthermore, the prior art approaches shown in the patents discussed above can be used to secure axially adjacent side panels together while still allowing axial collapse. Similarly, a wide variety of structures can be used to brace the front section in a lateral impact, including the restraining cables and guides shown in Stevens U S Pat. No. 4,452,431 and VanSchie U.S. Pat. No. 4,399,980.

By arranging the side panels 216 as shown in FIG. 20 a bidirectional barrier 200 is provided which performs three separate functions. First, it collapses axially to retard an axially impacting vehicle striking the front section 204. Second, it redirects a vehicle travelling on the roadway R1 which strikes the barrier 200 laterally along its length, without spearing the vehicle. Third, it redirects a vehicle travelling on the roadway R2 which strikes the barrier 200 laterally, again without spearing the vehicle. These advantages have been obtained without increasing the cost or complexity of the system.

Of course, it should be understood that a wide range of changes and modifications can be made to the preferred embodiments described above. For example, the breakaway assembly 100 and the tension straps 46 described above can be used with more conventional crash barriers which do not rely on friction brakes such as the brake assemblies 140. Additionally, the brake assembly 140 can be modified to use a wide variety of braking means and biasing means, including other types of springs and hydraulic biasing arrangements. Of course, dimensions, proportions and shapes can all be modified to suit the intended application.

It is therefore intended that the foregoing detailed description be regarded as illustrative rather than limiting, and that it be understood that it is the following claims, including all equivalents, which are intended to define the scope of this invention.

We claim:

1. A vehicle crash barrier for decelerating a vehicle, said crash barrier comprising:

an elongated frame comprising a plurality of sections including a front section and at least one additional section arranged end to end along an axial direction, said frame configured to collapse axially when struck axially on the front section by a vehicle;

a tension member positioned generally parallel to the frame and having a forward end portion anchored independently of the frame and rearward end portion;

brake means for resiliently biasing a brake member against the tension member, said brake means mounted in the frame and frictionally engaged with the tension member such that, following an impart of the vehicle against the front section that causes the frame to collapse axially, the vehicle causes the brake means to move along the tension member and to generate a frictional retarding force to decelerate the vehicle.

2. The invention of claim 1 wherein the brake member comprises a pair of brake sleeves positioned around the tension member.

3. The invention of claim 1 wherein the brake means comprises a spring coupled to the brake member to bias the brake member against the tension member.

4. The invention of claim 3 wherein the spring comprises a spring plate having a central portion and a peripheral portion, and means for flexing the spring plate central portion with respect to the peripheral portion to bias the brake member against the tension member.

5. The invention of claim 2 wherein the brake sleeve is formed of an aluminum alloy.

6. The invention of claim 5 wherein the aluminum alloy is 6061-T6.

7. The invention of claim 1 further comprising means for mounting the brake means in the front section such that the brake means is free to slide in the front section along a selected stroke oriented in the axial direction to reduce initial vehicle deceleration.

8. The invention of claim 1 wherein the brake means engages a selected segment of the tension member prior to impact of the vehicle, and wherein the selected segment is covered with a friction reducing material to reduce initial vehicle deceleration.

9. The invention of claim 8 wherein the friction reducing material comprises zinc.

10. The invention of claim 8 wherein friction reducing material comprises a plastic.

11. The invention of claim 8 wherein the friction reducing material comprises a lubricant.

12. The invention of claim 1 further comprising:

means for anchoring the rearward end portion of the tension member; and means for coupling the frame to the tension member at a plurality of spaced locations along the frame such that the tension member braces the frame in a lateral impact.

13. The invention of claim 1 further comprising:

an anchor;

a fastener coupled to the front section to releasably secure the front section to the anchor;

a release member having a first end positioned to be moved axially by an axially impacting vehicle and a second end coupled to the fastener to release the fastener when the first end is moved axially, the said release member positioned and configured to avoid releasing the fastener when struck by a laterally impacting vehicle.

14. The invention of 13 wherein the release member defines a fulcrum that bears against a reaction surface, wherein the fulcrum is positioned closer to the second end than the first end, and wherein the release member is positioned such that an axially impacting vehicle pivots the release member about the fulcrum to part the fastener, thereby releasing the front section.

15. The invention of claim 1 wherein each section of the frame comprises a pair of spaced side panels, one on each side of the tension member; and wherein the frame further comprises:

a plurality of straps; and a plurality of fasteners secured to the straps and the side panels such that each strap interconnects a respective pair of axially adjacent side panels;

said side panels and straps configured to pull the fasteners sequentially out of at least one of the side panels and the straps in response to axial movement of the frame when a vehicle axially impacts the front section, thereby disconnecting the respective axially adjacent segments to allow the frame to collapse axially.

16. The invention of claim 15 wherein each of the straps comprises a plurality of parallel plates lying one over the other.

17. The invention of claim 1 wherein the brake means comprises means for transmitting axial forces from the frame to the brake member immediately adjacent to the tension member to enhance alignment of the brake member on the tension member.

18. The invention of claim 1 wherein the brake means is mounted to the frame to allow the brake means limited movement with respect to the frame to enhance alignment of the brake means on the tension member.

19. A vehicle crash barrier for decelerating a vehicle that has left a roadway, said crash barrier comprising:

spaced front and rear ground anchors;

a tension member stretched between the ground anchors;

an elongated frame comprising a plurality of sections including a front section and a plurality of additional sections arranged end to end along the tension member; each of said sections comprising two side panels disposed on respective sides of the tension member and a ground support leg, at least some of the legs defining openings through which the tension member passes such that the legs are slidable along the tension member; a plurality of straps, each connected between axially adjacent side panels by a plurality of fasteners, wherein each axially adjacent pair of the side panels overlap, wherein the fasteners connect a first portion of each strap to one of the respective pair of overlapping side panels and a second portion of each strap to the other of the respective pair of side panels, and wherein the straps and side panels are configured to peel the fasteners sequentially out of at least one of the side panels and the straps in response to axial movement of the frame when a vehicle axially impacts the front section;

directionally sensitive means for fastening the front section to the front ground anchor and for preferentially releasing the front section from the front ground anchor in response to an axial vehicle impact; and brake means slidably mounted in the front section to slide along the tension member and generate a frictional retarding force tending to decelerate the vehicle, said brake means comprising a plurality of brake sleeves shaped to grip the tension member and means for resiliently biasing the brake sleeves against the tension member.

20. The invention of claim 19 wherein the brake means engages a selected segment of the tension member prior to impact of the vehicle, and wherein the selected segment is covered with a friction reducing material to reduce initial vehicle deceleration.

21. The invention of claim 20 wherein the friction reducing material comprises zinc.

22. The invention of claim 20 wherein friction reducing material comprises a plastic.

23. The invention of claim 20 wherein the friction reducing material comprises a lubricant.

24. The invention of claim 19 wherein the fastening means comprises:

a bolt interconnecting the front section and the front ground anchor; and a release lever having a lower end coupled to the bolt, an upper end coupled to a forward portion of the front section, and a fulcrum supported by a reaction surface on the ground anchor such that an axial impact on the front section pivots the release lever about the fulcrum in an axial direction and parts the bolt.

25. The invention of claim 19 wherein the brake means comprises means for transmitting axial forces from the frame to the brake sleeves immediately adjacent to the tension member to enhance alignment of the brake member on the tension member.

26. The invention of claim 19 wherein the brake means is mounted to the frame to allow the brake means limited movement with respect to the frame to enhance alignment of the brake means on the tension member.

27. A vehicle crash barrier for decelerating a vehicle that has left a roadway, said crash barrier comprising:

an elongated frame comprising a plurality of sections including a front section and at least one additional section arranged end to end along an axial direction, said frame configured to collapse axially when struck axially on the front section by a vehicle;

at least some of said frame sections each comprising at least one side panel, at least first and second of said side panels axially aligned with and partially overlapping one another, and a strap defining first and second sets of axially spaced openings;

a plurality of fasteners positioned in the openings and securing the first and second side panels such that the fasteners in the first set of openings are secured to the first side panel and the fasteners in the second set of openings are secured to the second side panel;

said side panels, straps and fasteners configured such that axial collapse of the frame causes the first and second side panels to bend the strap into an S shape and to peel the fasteners sequentially out of one of the first panel and the strap, thereby disconnecting the first panel from the strap.

28. The invention of claim 27 wherein the first side panel is positioned nearer the front section than the second side panel.

29. The invention of claim 28 wherein each of the frame sections comprises two side panels, each axially aligned with and laterally spaced from the other.

30. A vehicle crash barrier for decelerating a vehicle that has left a roadway, said crash barrier comprising:

an elongated frame comprising a plurality of sections including a front section and at least one additional section arranged end to end along an axial direction, said frame configured to collapse axially when struck axially on the front section by a vehicle;

a ground anchor;

a fastener secured between the front section and the ground anchor; and a release lever having a lower end coupled to the fastener, an upper end positioned at a forward portion of the front section, and a fulcrum supported by a reaction surface such that an axial impact on the front section pivots the release lever about the fulcrum in an axial direction and parts the fastener to release the front section from the ground anchor.

31. The invention of claim 30 wherein the reaction surface is positioned on the ground anchor.

32. The invention of claim 30 wherein the upper end of the release lever extends forwardly of the lower end of the release lever.

33. A bidirectional vehicle crash barrier adapted for use between two adjacent roadways, one carrying vehicles in a first direction and the other carrying vehicles in a second direction, oriented opposite the first direction, said barrier comprising:

a collapsible frame comprising a plurality of sections including a front section, at least one middle section, and a rear section, each of said sections comprising two side panels, each on a respective side of the frame, each side panel having a forward end nearer the front section and a rearward end nearer the rear section;

the side panels on a first side of the frame overlapping with the rearward ends of the side panels disposed outwardly to protect a vehicle moving toward the rear section from contact with the forward ends of the side panels on the first side;

the side panels on a second side of the frame overlapping with the forward ends of the side panels disposed outwardly to protect a vehicle moving toward the front section from contact with the rearward ends of the side panels on the second side; and means in the frame for retarding axial collapse of the frame when the frame is struck by a vehicle axially on the front section to provide a decelerating force to the vehicle;

wherein one of the sections of the frame is braced against axial collapse such that the braced section is more resistant to axial collapse during axial collapse of the frame than at least some other of the sections to protect an impacting vehicle from being speared by the side panels on the second side of the frame.

34. The invention of claim 33 wherein the braced section is the front section.

35. The invention of claim 34 wherein the braced front section is sufficiently resistant to axial collapse so as not to collapse in operation.

36. The invention of claim 33 wherein the retarding means comprises a tension member and a friction brake coupled between the frame and the tension member to retard axial collapse of the frame as the brake moves along the tension member.

37. The invention of claim 36 wherein the brake comprises a braking member and means for resiliently biasing the braking member against the tension member.

38. The invention of claim 33 wherein the retarding means comprises a plurality of energy absorbing members positioned in the frame to retard axial collapse of the frame as a result of compressive deformation of the energy absorbing members.

39. The invention of claim 33 wherein the rear section side panel of the first side is secured to a first side of a guardrail in a manner to facilitate telescoping therebetween, and wherein the rear section side panel of the second side is fixedly secured to a second side of the guardrail.

40. A bidirectional vehicle crash barrier adapted for use between two adjacent roadways, one carrying vehicles in a first direction and the other carrying vehicles in a second direction, oriented opposite the first direction, said barrier comprising:

a collapsible frame comprising a plurality of sections including a front section, at least one middle section, and a rear section, each of said sections comprising two side panels, each on a respective side of the frame, each side panel having a forward end nearer the front section and rearward end nearer the rear section;

the side panels on a first side of the frame overlapping with the rearward ends of the side panels disposed outwardly to protect a vehicle moving toward the rear section from contact with the forward ends of the side panels on the first side;

the side panels on a second side of the frame overlapping with the forward ends of the side panels disposed outwardly to protect a vehicle moving toward the front section from contact with the rearward ends of the side panels on the second side; and means in the frame for retarding axial collapse of the frame when the frame is struck by a vehicle axially on the front section to provide a decelerating force to the vehicle;

wherein the retarding means comprises a tension member and a friction brake coupled between the frame and the tension member to retard axial collapse of the frame as the brake moves along the tension member.

41. The invention of claim 40 wherein the brake comprises a braking member and means for resiliently biasing the braking member against the tension member.

42. The invention of claim 40 wherein the retarding means comprises a plurality of energy absorbing members positioned in the frame to retard axial collapse of the frame as a result of compressive deformation of the energy absorbing members.

43. A bidirectional vehicle crash barrier adapted for use between two adjacent roadways, one carrying vehicles in a first direction and the other carrying vehicles in a second direction, oriented opposite the first direction, said barrier comprising:

a collapsible frame comprising a plurality of sections including a front section, at least one middle section, and a rear section, each of said sections comprising two side panels, each on a respective side of the frame, each side panel having a forward end nearer the front section and a rearward end nearer the rear section;

the side panels on a first side of the frame overlapping with the rearward ends of the side panels disposed outwardly to protect a vehicle moving toward the rear section from contact with the forward ends of the side panels on the first side;

the side panels on a second side of the frame overlapping with the forward ends of the side panels disposed outwardly to protect a vehicle moving toward the front section from contact with the rearward ends of the side panels on the second side; and means in the frame for retarding axial collapse of the frame when the frame is struck by a vehicle axially on the front section to provide a decelerating force to the vehicle;

wherein the rear section side panel of the first side is secured to a first side of a guardrail in a manner to facilitate telescoping therebetween, and wherein the rear section side panel of the second side is fixedly secured to a second side of the guardrail.

* * * * *